US005261380A

United States Patent [19]

Romano

[11] Patent Number: 5,261,380

[45] Date of Patent: Nov. 16, 1993

[54] CRANKCASE VENTILATION SYSTEM FOR AUTOMOTIVE ENGINE

[75] Inventor: Ronald Romano, Canton, Mich.

[73] Assignee: Ford Motor Company, Dearborn, Mich.

[21] Appl. No.: 913,332

[22] Filed: Jul. 15, 1992

[51] Int. Cl.[5] ..... F02B 25/06

[52] U.S. Cl. ..... 123/573; 55/DIG. 19

[58] Field of Search ..... 123/572, 573, 41.86; 55/DIG. 19

[56] References Cited

U.S. PATENT DOCUMENTS

| | | | |
|---|---|---|---|
| 1,039,677 | 9/1912 | Theisen | 55/408 |
| 1,447,160 | 2/1923 | Thompson | 55/408 |
| 1,872,609 | 8/1932 | Schittke | 123/41.86 |
| 2,209,607 | 7/1940 | Nutting | 55/407 |
| 2,228,129 | 1/1941 | Stephano | 55/408 |
| 2,344,068 | 3/1944 | Waseige | 55/407 |
| 2,779,434 | 1/1957 | Smith | 55/271 |
| 3,234,716 | 2/1966 | Sevin et al. | 55/408 |
| 3,246,639 | 4/1966 | Oliver | 55/DIG. 19 |
| 3,293,832 | 12/1966 | Loftheim | 55/407 |
| 3,406,504 | 10/1968 | Sylvan | 55/408 |
| 3,686,831 | 8/1972 | Libby | 55/406 |
| 3,720,045 | 3/1973 | Murphy | 55/407 |
| 4,963,329 | 10/1990 | Burgess et al. | 55/408 |

OTHER PUBLICATIONS

SAE Paper (Feb. 1992) "Coswroth MBA Engine".

*Primary Examiner*—Noah P. Kamen

*Attorney, Agent, or Firm*—Jerome R. Drouillard; Roger L. May

[57] ABSTRACT

A ventilation system for an automotive engine having a crankcase, 12, an induction system, 14, 16, crankshaft, 18, and at least one camshaft, 20. A processor, 22, pumps gases from the crankcase and separates entrained lubricating oil from the pumped gas flow. A recovery apparatus, 24, 30 introduces the separated gas to the induction system while returning the separated oil to the crankcase.

2 Claims, 4 Drawing Sheets

CRANKCASE VENTILATION SYSTEM FOR AUTOMOTIVE ENGINE

BACKGROUND AND SUMMARY OF THE INVENTION

Automotive engine designers have used a variety of schemes to handle the flow of blowby gases originating in the crankcase of the engine. A scheme disclosed in a February, 1992 Society of Automotive Engineers ("SAE") publication titled "Cosworth MBA Engine" includes a hollow, ported balance shaft which centrifugally separates oil from the crankcase gases. The system shown in the SAE publication does not produce any pumping action of its own but merely relies upon the suction produced by the induction process to move the blowby gases through the separator.

The present invention solves the problem of preventing excessive lubricating oil from passing through the crankcase ventilation flow of the engine while at the same time obviating the need for an additional mechanism such as a balance shaft. The present system provides a powered oil separator without the need for additional gears, shafts, motors, or other devices, and it is suitable for use with engines having camshafts mounted either interior to, or externally of the cylinder block.

According to one aspect of the present invention, a ventilation system for an automotive engine having a crankcase, an induction system, a crankshaft, and at least one camshaft driven by the crankshaft, includes processor means for pumping gases from the crankcase and for separating entrained lubricating oil from the pumped gas flow, with the processor means including a blower operatively associated with the camshaft. The blower works in concert with intake manifold vacuum to move blowby gases into the engine's air inlet. A system according to this invention also includes recovery means for introducing the separated gas into the induction system and for returning the separated oil to the crankcase.

DETAILED DESCRIPTION OF THE PREFERRED EMBODIMENTS

Figure 1:
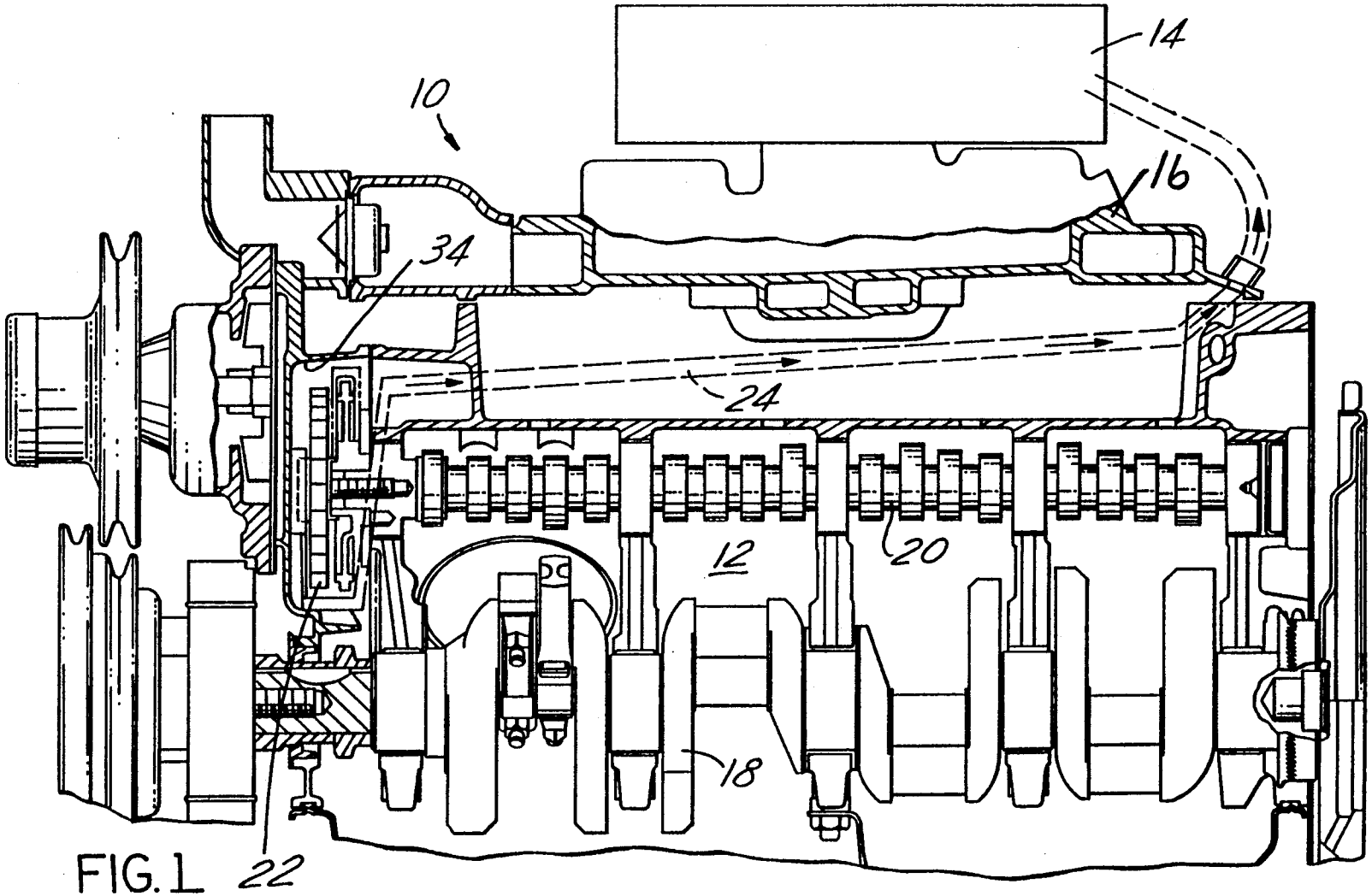
FIG. 1 is a schematic illustration of an engine having a crankcase ventilation system according to the present invention.

FIG. 1 illustrates an automotive engine, 10, having a crankcase, 12, an induction system including an intake manifold, 16, a crankshaft, 18, and a camshaft, 20, which is driven by the crankshaft by either gears, or by a synchronous belt, or by a chain, or by any other type of camshaft driving arrangement known to those skilled in the art and suggested by this disclosure.

Engine 10 includes a crankcase ventilation system, having a processor, 22, for pumping blowby gases from crankcase 12 and for separating entrained lubricating oil from the pumped gas flow. The ventilation system further includes recovery means for introducing the separated gas to the induction system and for returning the separated oil to the crankcase. In the embodiment illustrated in FIG. 1, the recovery means includes a gas recovery duct, 24, for conducting the separated blowby gases to an air inlet, 14, which is part of the induction system of the engine. The separated oil is allowed to flow down around the sides of a housing, 34, in which processor 22 is mounted.

Figure 2:
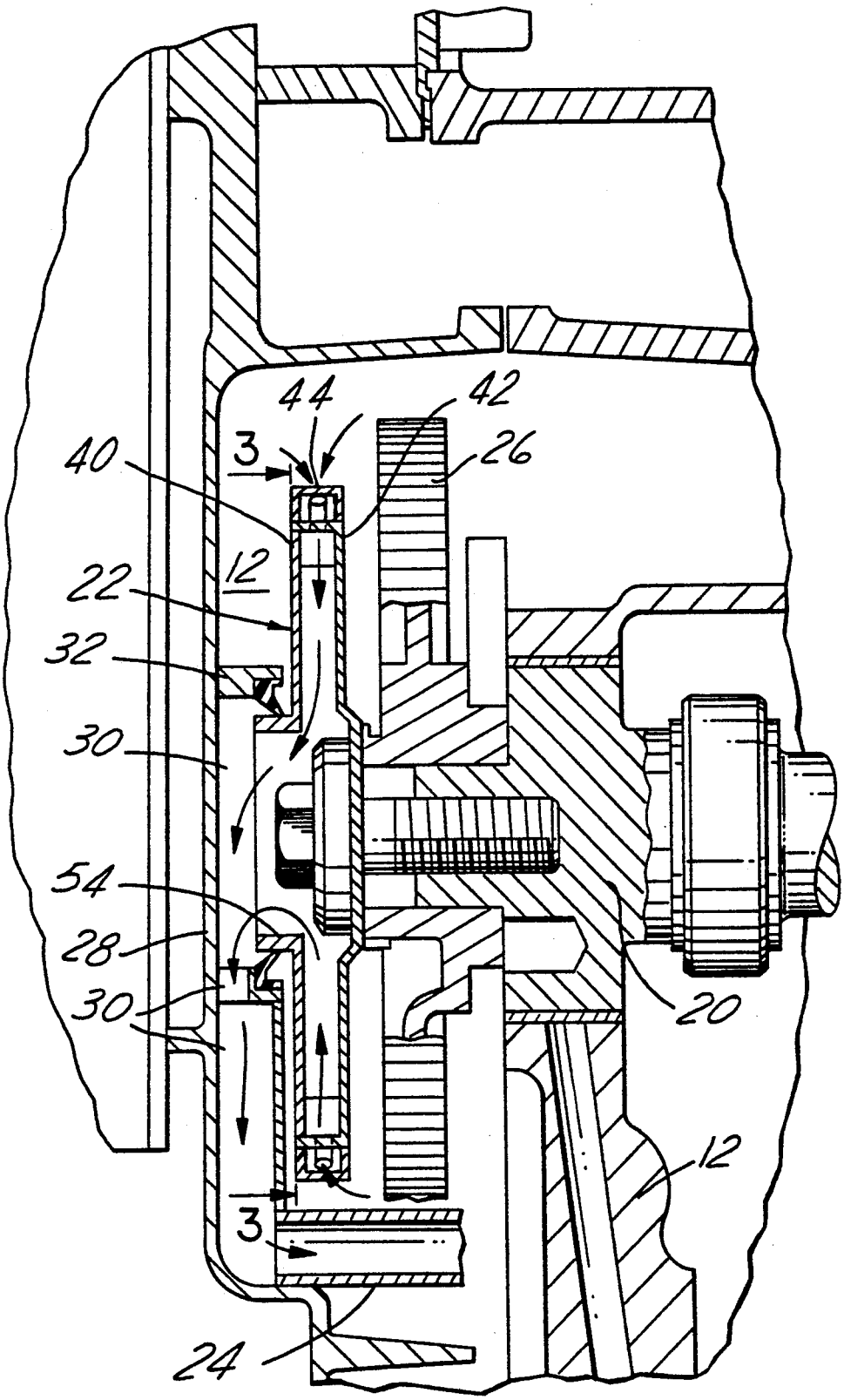
FIG. 2 is an enlarged section of the engine of FIG. 1 which shows with particularity one embodiment of the present invention.
Figure 3:
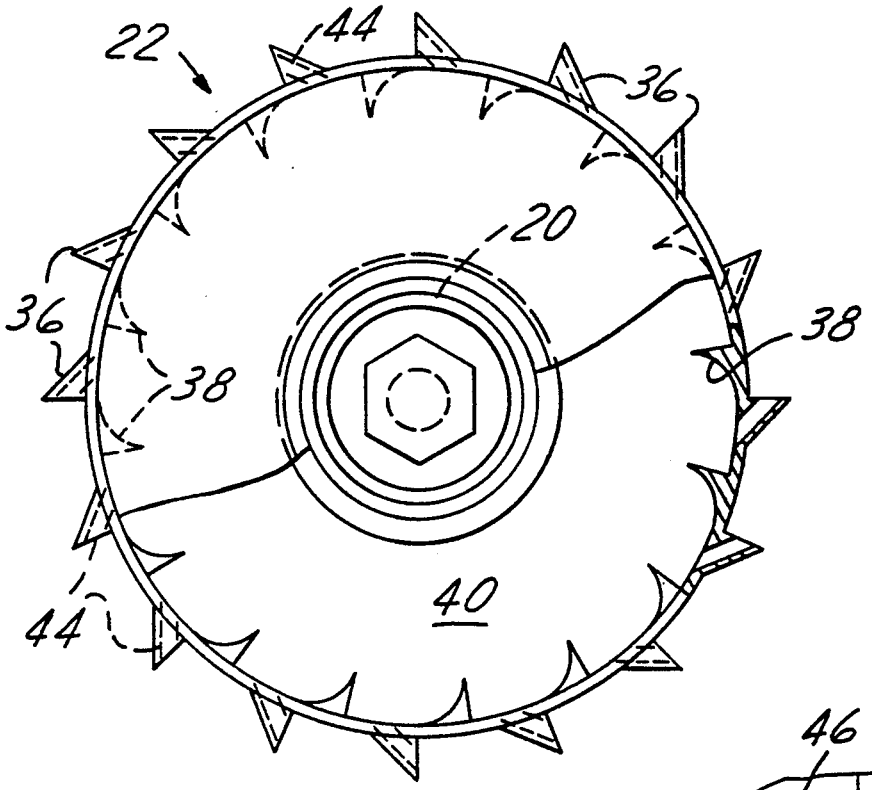
FIG. 3 illustrates a centrifugal blower according to one aspect of the present invention.

FIG. 2 illustrates the system of FIG. 1 in greater detail and includes a centrifugal blower as processor 22. Note that blower wheel 22 is mounted to camshaft 20 and turns synchronously therewith. The blower wheel is mounted immediately ahead of driven sprocket 26 which could comprise a gear, a chain sprocket or synchronous belt type of sprocket. Blowby gases originating in crankcase 12 are drawn through processor 22 by intake manifold vacuum and by the action of the processor itself. The gases first flow radially inwardly from the outer periphery of processor 22 through the annular space formed by front plate 40 and rear plate 42. This flowing is aided as shown in FIG. 3 by a plurality of internal fins, 38, which work in concert with intake manifold vacuum to create a slightly lower pressure in the interior of blower wheel 22. External fins 36, each having an orifice, 44, therethrough, serve the dual purpose of allowing blowby gases to pass through orifices 44 while fins 36 spin off oil entrained in the blowby gases.

After entering the interior of processor 22, gases flow radially inwardly and then outwardly axially through cylindrical section 54 (FIG. 2). Thereafter, the gases flow downwardly through flowpath 30 defined by engine front cover 28 and then through gas recovery duct 24 to engine air inlet 14. Note from FIG. 2 that seal 32 is provided about the outer periphery of cylindrical section 54 so as to prevent oil which is thrown off by processor 22 from entering gas recovery duct 24.

Figure 4:
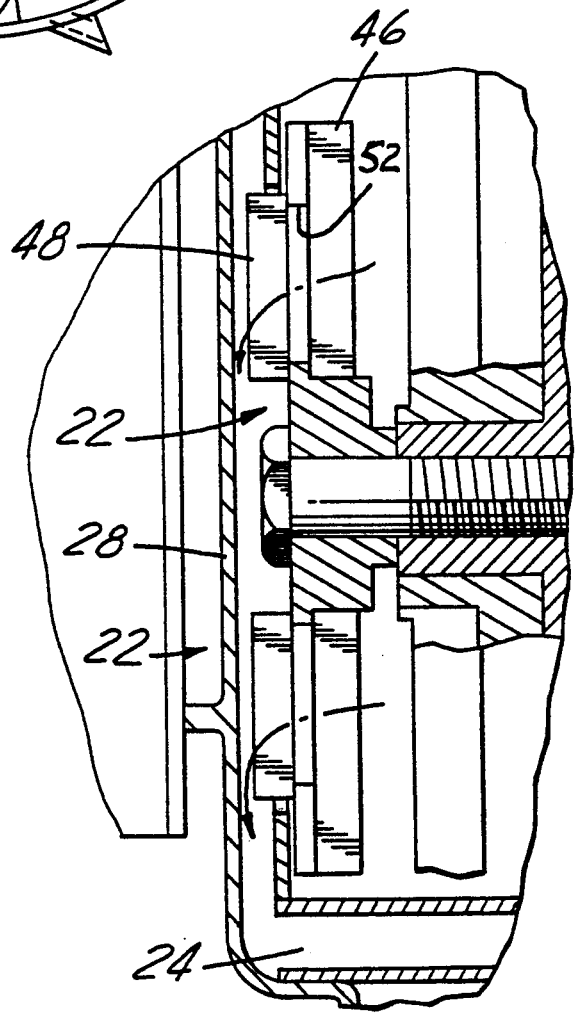
FIG. 4 illustrates a second type of blower according to one aspect of the present invention.
Figure 5:
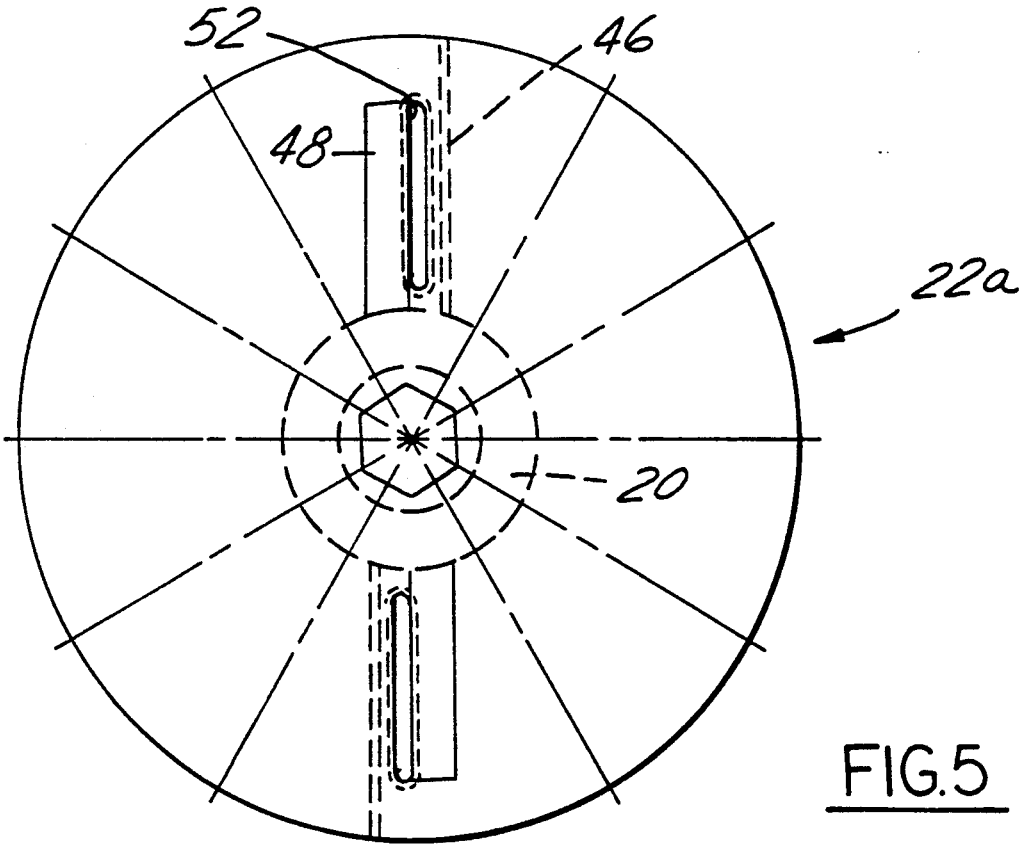
FIG. 5 is a plan view of the blower wheel of FIG. 4.

FIGS. 4 and 5 illustrate a second embodiment according to the present invention which an axial flow blower 22 is used. This blower has a plurality of leading fins, 46, which deflect oil droplets away from the spinning wheel. The blowby gases then pass through a series of orifices, 52, in an axial flowpath. Thereafter the gases pass over a series of trailing fins, 48, which are curved so as to pull the blowby gases through orifices 52. As with the previous embodiment, the gases pass within a space formed by the front of the blower wheel and the rear portion of front cover 28 and then into gas recovery duct 24, enroute to the engine's induction system.

Those skilled in the art will appreciate in view of this disclosure that a system according to the present invention could be applied to a variety of types of engines, including those having overhead camshaft configurations.

I claim:

1. A ventilation system for an automotive engine having a crankcase, an induction system, a crankshaft, and at least one camshaft driven by the crankshaft, comprising:

processor means for pumping gases from the crankcase and for separating entrained lubricating oil from the pumped gas flow, with said processor means comprising a blower mounted upon said camshaft; and recovery means for introducing the separated gas to the induction system and for returning the separated oil to the crankcase with said blower comprising a centrifugal pumping element having:

a circular rear plate attached to said camshaft;

a circular front plate having a cylindrical axial flow section formed at its center and being axially separated from said rear plate so as to form therewith an annular flow area; and an annular rim section joining said front and rear plates and comprising:

a plurality of external oil slinger fins mounted about the outer diameter of the plates, with at least one of said fins having a passage therein for permitting blowby gas to enter the annular flow area; and a plurality of internal gas pumping fins extending generally radially inwardly from the outer diameter of the outer diameter of the plates.

2. A ventilation system for an automotive engine having a crankcase, an induction system, a crankshaft, and at least one camshaft driven by the crankshaft, comprising:

processor means for pumping gases from the crankcase and for separating entrained lubricating oil from the pumped gas flow, with said processor means comprising a blower mounted upon said camshaft; and recovery means for introducing the separated gas to the induction system and for returning the separated oil to the crankcase with said blower comprising:

an axial flow pumping element comprising:

a circular center disk attached to said camshaft, with said disk having a leading side upon which blowby gases first impinge, and a trailing side from which blowby gases flow into the recovery system;

a plurality of radially extending oil slinger fins mounted on the leading side of the center disk;

a plurality of radially extending gas pumping fins mounted on the trailing side of the center disk; and a plurality of orifices extending through the center disk such that blowby gases will be caused to flow through the orifices as a result of the action of the gas pumping fins.

* * * * *